US011088431B2

(12) United States Patent
Guess

(10) Patent No.: US 11,088,431 B2
(45) Date of Patent: Aug. 10, 2021

(54) MULTIMODE RESONATORS WITH SPLIT CHAMFER

(71) Applicant: Huawei Technologies Co., Ltd., Shenzhen (CN)

(72) Inventor: Michael Guess, Kista (SE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/552,770

(22) Filed: Aug. 27, 2019

(65) Prior Publication Data

US 2019/0386370 A1 Dec. 19, 2019

Related U.S. Application Data

(63) Continuation of application No. PCT/EP2017/054511, filed on Feb. 27, 2017.

(51) Int. Cl.

*H01P 7/10* (2006.01)
*H01P 1/20* (2006.01)
*H01P 1/208* (2006.01)

(52) U.S. Cl.

CPC ..... *H01P 7/105* (2013.01); *H01P 1/2002* (2013.01); *H01P 1/2086* (2013.01); *H01P 1/2088* (2013.01)

(58) Field of Classification Search

CPC ..... H01P 1/2084; H01P 1/2082; H01P 1/208; H01P 1/2086; H01P 1/2002; H01P 1/2088; H01P 7/10; H01P 7/105

(Continued)

(56) References Cited

U.S. PATENT DOCUMENTS 2,518,383 A * 8/1950 Schelkunoff ..... H01P 7/06 333/227
5,436,602 A 7/1995 McVeety et al.

(Continued)

FOREIGN PATENT DOCUMENTS

CN 1197305 A 10/1998
CN 1419311 A 5/2003

(Continued)

OTHER PUBLICATIONS

Khan et al.,"Dual-Mode Bandpass Filter using Via Less Substrate Integrated Waveguide Technology," 2015 International Conference on Microwave and Photonics (ICMAP), total 2 pages (2015).

(Continued)

*Primary Examiner* — Stephen E. Jones
(74) *Attorney, Agent, or Firm* — Leydig, Voit & Mayer, Ltd.

(57) ABSTRACT

A multimode radio frequency resonator is provided. The multimode radio frequency resonator comprises: a monoblock of dielectric material having an initial shape that allows for multimode resonance, the initial shape comprising surfaces areas and edges between the surface areas. The multimode radio frequency resonator also comprises a conductive layer covering the whole surface of the monoblock, and a split chamfer disposed at one of the edges of the monoblock. The split chamfer includes two symmetrical cut-outs at the outer-most sides of the edge of the monoblock, and a central portion that is intact with respect to the initial shape of the monoblock and separates the symmetrical cut-outs. A method for tuning such a multimode radio frequency resonator is also described.

20 Claims, 7 Drawing Sheets

(58) Field of Classification Search
USPC ..... 333/202, 208, 209, 227, 229, 230, 231
See application file for complete search history.

(56) References Cited

U.S. PATENT DOCUMENTS

| | | | |
|---|---|---|---|
| 6,002,306 | A | 12/1999 | Arakawa |
| 6,072,378 | A | 6/2000 | Kurisu et al. |
| 6,278,344 | B1 | 8/2001 | Kurisu et al. |
| 6,496,087 | B1 | 12/2002 | Hattori et al. |
| 7,605,678 | B2 | 10/2009 | Ando et al. |
| 2003/0090344 | A1 | 5/2003 | Wang et al. |
| 2005/0128031 | A1 | 6/2005 | Wilber et al. |
| 2007/0152779 | A1 | 7/2007 | Ando et al. |
| 2013/0049890 | A1 | 2/2013 | Hendry et al. |

FOREIGN PATENT DOCUMENTS

| | | | |
|---|---|---|---|
| CN | 1492535 | A | 4/2004 |
| CN | 103972621 | A | 8/2014 |
| EP | 1962369 | B1 | 6/2014 |
| JP | H04287501 | A | 10/1992 |
| JP | H11191705 | A | 7/1999 |
| JP | 2001189601 | A | 7/2001 |
| JP | 2004266803 | A | 9/2004 |
| JP | 2004312287 | A | 11/2004 |

OTHER PUBLICATIONS

Zhang Yi-Fei et al., "Structure Design and Simulation of a 2 400 MHz Microwave Dielectric Dual-Mode Filter," Chinese Journal Of Electron Devices, vol. 31 No. 5, total 6 pages (Oct. 2008). with English Abstract.

Awai et al.,"A Dual Mode Dielectric Waveguide Resonator and Its Application to Bandpass Filters," 2334c IEICE Transactions on Electronics, vol. E78-C, No. 8, Tokyo, JP, XP000536085, pp. 1018-1025 (Aug. 1995).

Matthaei et al.,"Microwave Filters, Impedance-Matching Networks, and Coupling Structures," Artech House Inc., Norwood, MA (1964).

* cited by examiner

MULTIMODE RESONATORS WITH SPLIT CHAMFER

CROSS-REFERENCE TO RELATED APPLICATIONS

This application is a continuation of International Application No. PCT/EP2017/054511, filed on Feb. 27, 2017, the disclosure of which is hereby incorporated by reference in its entirety.

TECHNICAL FIELD

The embodiments of the present invention relate to the field of multimode radio frequency resonators and methods for tuning multimode radio frequency resonators.

BACKGROUND

As radios become more compact and integrated there is renewed demand to produce low-loss, high-power filters that are low volume or have a small form-factor. Primarily, this is to enable components to be tightly packed and used in conjunction with large antenna arrays for Multiple Input Multiple Output (MIMO), systems. Prior to final assembly in such a radio system, the filter component requires configuration in the form of frequency and bandwidth alignment, so that it meets the required specification.

Alignment of resonant frequencies of a multimode resonator has typically required a solid conducting rod or screw used to perturb the electric or magnetic fields within the interior a resonator body. For the case of a solid dielectric resonator, this has required holes to be formed within the resonator itself, in order to accommodate said conducting tuning element. This is undesirable because of added manufacturing complexity and increase in total volume, owing to the removal of dielectric material. Additionally, for multimode resonators used in a functional microwave or Radio Frequency (RF) filter, using conducting elements to perturb the Electromagnetic (EM) field of a resonator results in orthogonal modes coupling together—where their energy is shared or transferred—making further independent control of coupling impossible.

Alternative, non-intrusive methods to negate these issues have further problems. For example, grinding areas on orthogonal faces of a mono-block, to affect the necessary change of the resonant frequencies, may be very sensitive to small dimensional variations that result from an imprecise manufacturing process.

SUMMARY

An object of the embodiments of the present invention is to provide a multimode radio frequency resonator which at least partially resolves one or more problems of the prior art.

Another object of embodiments of the present invention is to provide a multimode radio frequency resonator in which coupling between the different resonant modes may be tuned.

Another object of embodiments of the present invention is to provide a method for tuning a multimode radio frequency resonator.

According to a first aspect, a multimode radio frequency resonator is provided. The multimode radio frequency resonator comprises: a monoblock of dielectric material having an initial shape that allows for multimode resonance, the initial shape comprising surfaces areas and edges between the surface areas. The multimode radio frequency resonator also comprises a conductive layer that covers the whole surface of the monoblock, and a split chamfer disposed at one of the edges of the monoblock. The split chamfer includes two symmetrical cut-outs at the outer-most sides of the edge of the monoblock, and a central portion that is intact with respect to the initial shape of the monoblock and separates the symmetrical cut-outs.

The conductive layer covering the whole surface of the monoblock is formed of a highly conductive material. The conductive material could be a metal. The surface covered by the conductive layer provides an additional electrical ground plane that is external to the resonator. This is comparable to conventional resonators, where the electrical ground is provided exclusively by the interior surface of the conductive coating.

At the outer-most sides of the edge of the monoblock, the magnetic fields of orthogonal modes of a resonator are weaker and not parallel as they are near the central portion of the edge that is intact with the initial shape. Thus, protruding a split chamfer on the outer-most sides into the monoblock has less effect on perturbation of the magnetic fields as compared to the central portion. This leads to smaller errors produced during manufacture, owing to a bigger size of the split chamfer, and provides more control of the perturbation that affects coupling between the orthogonal modes.

The monoblock of dielectric material has an initial shape that allows for multimode resonance. The initial shape may be any shape comprising surfaces areas and edges between the surface areas, which makes the multimode radio frequency resonator resonant at least in two modes.

In a first possible implementation form of a multimode radio frequency resonator according to the first aspect, the monoblock has a parallelepiped shape, and the multimode radio frequency resonator is operable as a dual-mode radio frequency resonator. The parallelepiped shape includes six surface areas and twelve edges between these surface areas. The shapes may have the shape of a rectangle or a parallelogram. In this implementation, the parallelepiped shape provides resonance at two modes at the same or close frequencies, while the third resonant mode's frequency significantly differs from the first two. The split chamfer is disposed at one of the edges where the magnetic fields of the two resonant modes at the same frequency are parallel at the centre.

In a second possible implementation form of a multimode radio frequency resonator according to the first aspect, the monoblock has a cubic shape, and the multimode radio frequency resonator is operable as a triple-mode radio frequency resonator. The cubic shape includes six square surface areas and twelve edges between these surface areas. The split chamfer may be disposed at any of the twelve edges. In this implementation, the cubic shape provides resonance at three modes.

In a third possible implementation form of a multimode radio frequency resonator according to the first aspect as such or according to any of the preceding implementation forms of the first aspect, the symmetrical cut-outs along the outer-most sides of the edge have a step-like shape. The symmetrical cut-outs may be of the same size. The step-like shape can suit certain manufacture processes and can efficiently move the electrical ground plane formed by the conductive layer covering the monoblock surface.

In a fourth possible implementation form of a multimode radio frequency resonator according to the first aspect as such or according to any of the first and second implementation forms of the first aspect, the symmetrical cut-outs along the outer-most sides of the edge have an angular shape. The symmetrical cut-outs may be of the same size. This form is easily implemented by machining.

In a fifth possible implementation form of a multimode radio frequency resonator according to the first aspect as such or according to any of the preceding implementation forms of the first aspect, the resonator further comprises at least one protrusion protruding into the monoblock. The at least one protrusion is disposed in the central portion of the split chamfer that is intact with the initial shape and is covered by the conductive layer. The protrusion is a hole or any other volume of removed dielectric material that is conductively coated and protrudes into the monoblock. The protrusion augments the coupling by a small amount since it is disposed in the region of high magnetic fields of the orthogonal modes.

In a sixth possible implementation form of a multimode radio frequency resonator according to the fifth implementation form of the first aspect, the at least one protrusion has a cylindrical or conical frustum shape. A cylindrical protrusion can be easier to manufacture. A protrusion with conical frustum shape provides better access for partial removal of conductive coating from its surface area.

In a seventh possible implementation form of a multimode radio frequency resonator according to the fifth implementation form of the first aspect, the at least one protrusion has a shape of a recessed trench. The recessed trench can provide shielding of external components from radiation, and affects the coupling of the orthogonal modes.

In an eighth possible implementation form of a multimode radio frequency resonator according to the fifth to seventh implementation forms of the first aspect, the multimode radio frequency resonator comprises a gap in the conductive layer inside the at least one protrusion. The gap has the effect of moving the conductive ground plane element towards or from the magnetic fields, thereby adjusting the coupling provided by the protrusion.

In an ninth possible implementation form of a multimode radio frequency resonator according to the fifth to eighth implementation forms of the first aspect, the multimode radio frequency resonator comprises at least one additional protrusion disposed in a surface area of the monoblock that houses the protrusion in the central portion of the split chamfer. The surface area that houses the protrusion in the central portion is also the surface area which shares the edge of the monoblock where the split chamfer is disposed. The additional protrusion provides additional tuning of the coupling between the orthogonal resonant modes. The additional protrusion may also have a cylindrical, conical frustum or recessed trench shape. The shape of the additional protrusion may match or differ from the shape of the first protrusion.

In a tenth possible implementation form of a multimode radio frequency resonator according to the ninth implementation form of the first aspect, the at least one additional protrusion is located on a side of the surface opposite to the central portion of the split chamfer. This location can provide fine-tuning of the coupling between orthogonal modes, as the additional protrusion located on the opposite side of the surface has an effect on the coupling opposite to the first protrusion disposed at the central portion of the edge of the split chamfer.

In an eleventh possible implementation form of a multimode radio frequency resonator according to the first aspect as such or according to any of the preceding implementation forms of the first aspect, the multimode radio frequency resonator further comprises a second split chamfer disposed at an edge of the monoblock on the same surface area opposite to the edge of the monoblock which houses the first split chamfer. The second split chamfer includes two symmetrical cut-outs at the outer-most sides of the edge of the monoblock, and a central portion that is intact with respect to the initial shape of the monoblock and separates the symmetrical cut-outs. The second split chamfer on the opposite side of the surface area provides a negative coupling to counter-act the positive coupling, similar to additional protrusions in previous implementations. The two split chamfers can be of different sizes to increase or control the nominal coupling. For the purposes of this description, "positive" effect on coupling refers to strengthening the overall coupling, and "negative" effect on coupling means weakening the overall resultant coupling between the modes.

In an twelfth possible implementation form of a multimode radio frequency resonator according to the first aspect as such or according to any of the preceding implementation forms of the first aspect, the dielectric material of the monoblock is a ceramic material. The ceramic material may be a titanite-based ceramic material due to its density and dielectric properties.

In an twelfth possible implementation form of a multimode radio frequency resonator according to the first aspect as such or according to any of the preceding implementation forms of the first aspect, the multimode radio frequency resonator is used in a filter assembly of a multiple-input and multiple-output (MIMO) system.

According to a second aspect, a communication device for a wireless communication system is provided. The communication device comprises a multimode radio frequency resonator according to any of the first to eleventh implementation forms of the first aspect or to the first aspect as such.

According to a third aspect, a method is provided for tuning a multimode radio frequency resonator. The multimode radio frequency resonator comprises: a monoblock of dielectric material, a conductive layer covering the whole surface of the monoblock, a split chamfer disposed at one of the edges of the monoblock comprising two symmetrical cut-outs at the outer-most sides of the edge of the monoblock, and a central portion comprising at least one protrusion protruding into the monoblock. The method comprises selectively removing the conductive layer from a surface area inside the at least one protrusion, to form at least one non-conductive area on the monoblock surface.

At the outer-most sides of the edge of the monoblock, the magnetic fields of orthogonal modes of a resonator are weaker and not parallel as they are near the central portion of the edge that is intact with the initial shape. This makes any changes in the central portion have more effect on perturbation of the magnetic fields. The selective removal of the conductive layer from an area inside the protrusion located in the central portion can provide sensitive fine-tuning of the coupling between orthogonal resonant modes.

In a first implementation form of a method according to the third aspect, the conductive layer is selectively removed from the surface area inside the at least one protrusion by laser ablation. Laser ablation provides accuracy and control of the process. The selective removal can alternatively be performed by mechanical grinding or any other suitable technique.

In alternative implementation forms of the method according to the third aspect, the conductive layer can be selectively removed from other areas of the surface of the monoblock. These surface areas may include surface areas inside one or more additional protrusions, and surface areas inside the symmetrical cut-outs of the split chamfer. This can improve precision of the tuning and be more suitable for designs according to some of the implementation forms of the multimode radio frequency resonator according to the first aspect.

According to a fourth aspect, a computer program is provided comprising means for implementing the method according to any of the implementations of the third aspect, or the third aspect as such.

SHORT DESCRIPTION OF THE DRAWINGS

FIG. 1*a* shows the electrical and magnetic vectors for a first mode in a multimode radio frequency resonator.

FIG. 1*b* shows the electrical and magnetic vectors for a second mode in the multimode radio frequency resonator of FIG. 1*a*.

FIG. 2*a* is a perspective view of a multimode radio frequency resonator with a split chamfer according to an embodiment of the disclosure.

FIG. 2*b* is a perspective view of a multimode radio frequency resonator with a split chamfer of a different shape according to another embodiment of the disclosure.

FIG. 3*a* is a perspective view of a multimode radio frequency resonator with a cylindrical protrusion according to another embodiment of the disclosure.

FIG. 3*b* is a perspective view of a multimode radio frequency resonator with a conical protrusion according to another embodiment of the disclosure.

FIG. 4 is a side view of a multimode radio frequency resonator similar to that of FIG. 3*b*.

FIG. 5*a* is a perspective view of a multimode radio frequency resonator with an additional protrusion according to another embodiment of the disclosure.

FIG. 5*b* is a perspective view of a multimode radio frequency resonator with protrusions shaped as a trench according to another embodiment of the disclosure.

FIG. 6*a* is a perspective view of a multimode radio frequency resonator with multiple additional protrusions according to another embodiment of the disclosure.

FIG. 6*b* is a perspective view of a multimode radio frequency resonator with multiple additional protrusions of different shapes according to another embodiment of the disclosure.

DETAILED DESCRIPTION

Figure 1A:
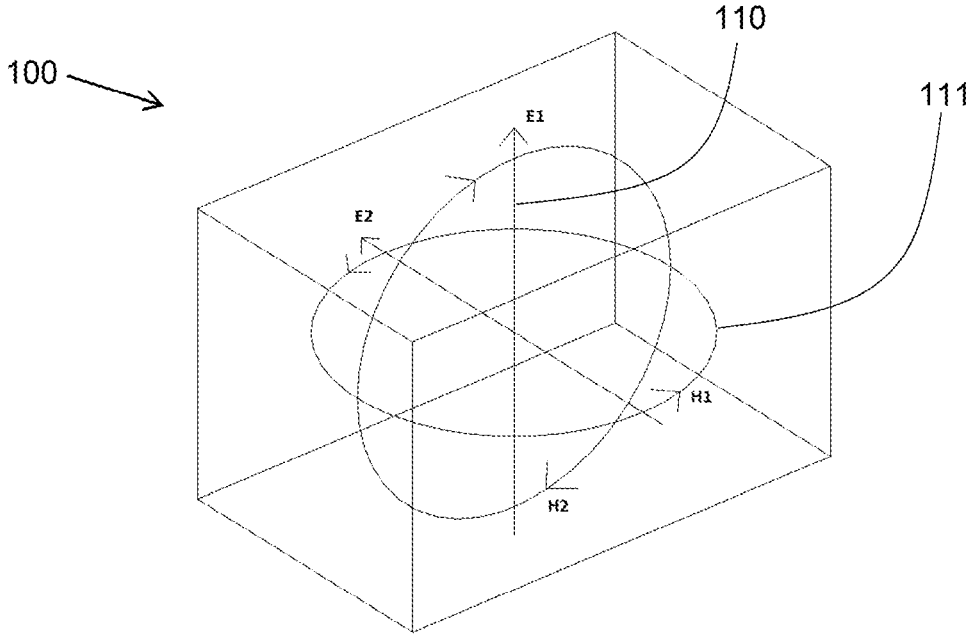

Below a description of embodiments will follow. In the following description of embodiments of the disclosure the same reference numerals will be used for the same or equivalent features in the different drawings.

Figure 1B:
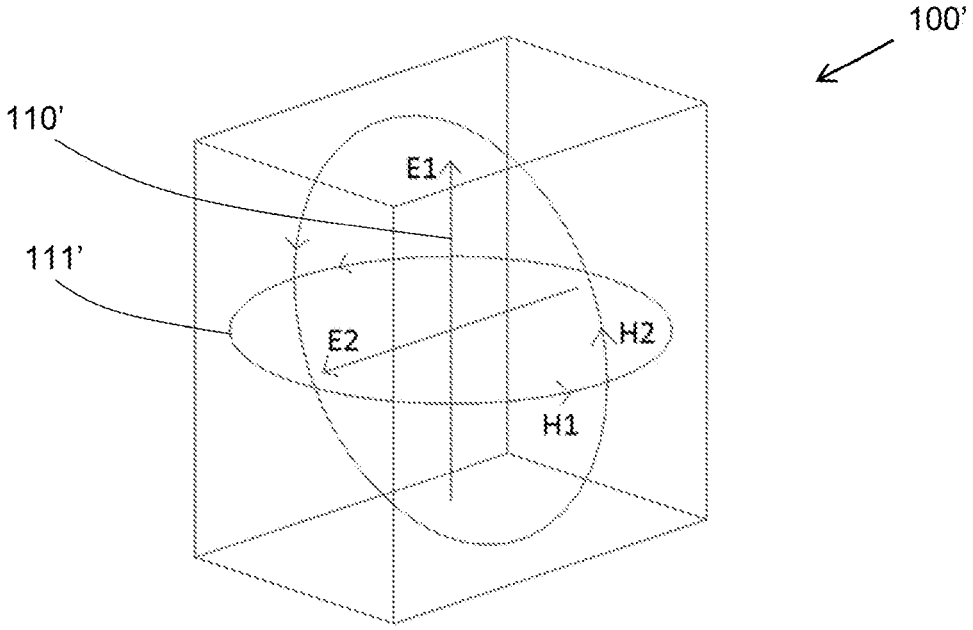

The embodiments described below relate to multimode radio frequency resonators that comprise a solid dielectric monoblock. The monoblock may be shaped as a cube, a parallelepiped or any other shape that allows for resonance in the monoblock at two or more modes. FIGS. 1*a*-1*b* show the parallelepiped example with field lines for orthogonal resonant modes. FIGS. 1*a* and 1*b* are simple illustrations of resonant modes appearing in a dual-mode resonator.

The magnetic and electric field configurations of the dominant modes in a dual-mode radio frequency resonator 100 can be seen in FIGS. 1*a* and 1*b*. It is possible to use one or all of these modes as primary resonances, where energy is coupled between them, to form a filter.

The magnetic fields H1, H2 indicated by field vectors 111 correspond to the electric fields E1 and E2 indicated by field vectors 110. As it is clear to a skilled person, since the magnetic field lines 111 follow the electric field lines 110, there are regions within the resonator where otherwise orthogonal magnetic fields are present and parallel to each other. For example, H1 can be substantially parallel H2 near the corresponding edges of the dual-mode resonator 100. By perturbing these fields, it is possible to couple energy from one mode to the next. The same applies to the fields 110' and 111' of the device 100' shown on FIG. 1*b* with slightly different dimensions.

While the resonator according to embodiments of the disclosure may be of any initial shape, in the dual-mode resonators 100, 100' illustrated herein the third resonance is positioned to be significantly above or below the primary resonance modes in frequency, due to the design of the resonator dimensions. Thus the third mode is not shown on FIGS. 1*a*-1*b*. For the purposes of this description, examples are limited to dual-mode resonators, for clarity and consistency. As would be clear to a skilled person, all aspects of the disclosure are applicable without limitation to resonators of any other shape suitable for multimode resonance.

The embodiments described below provide a coupling structure in a resonator with a solid dielectric body in such a way as to make the desired coupling minimally sensitive to small dimensional variations that result from an imprecise manufacturing process.

Figure 2A:
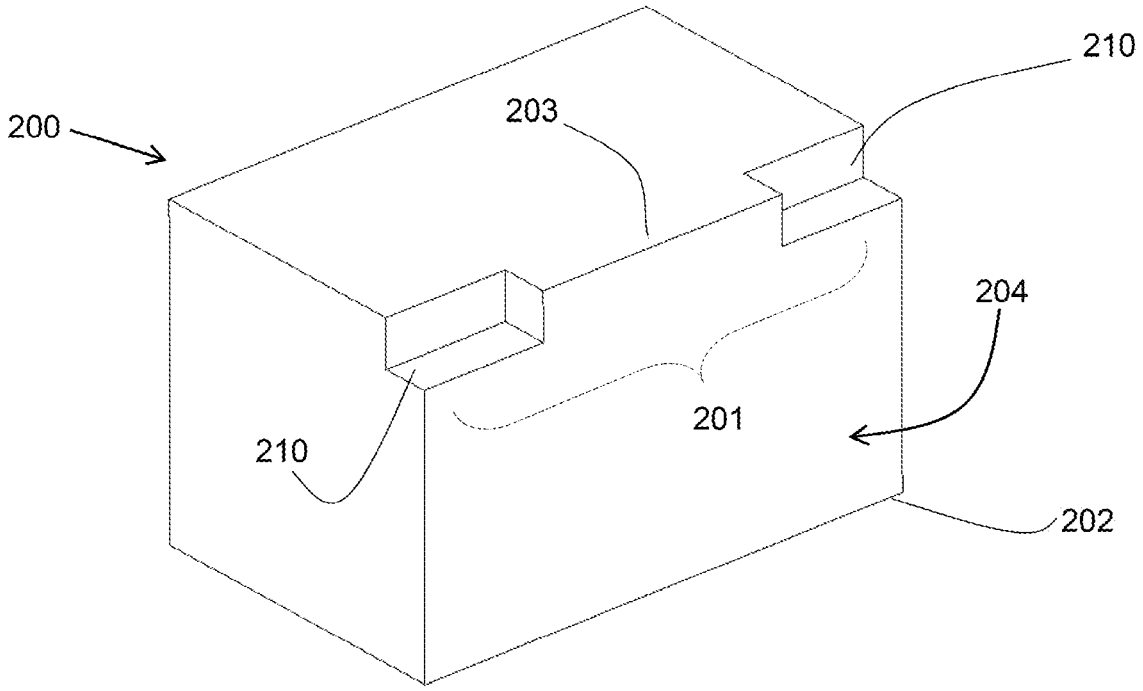

FIG. 2*a* shows a dual-mode radio frequency resonator 200 comprising a monoblock 202 of dielectric material, a conductive layer 204 covering the monoblock 202, and a split chamfer 201 disposed at one of the edges of the monoblock 202. The split chamfer 201 includes two symmetrical cut-outs 210 at the outer-most sides of the edge of the monoblock 202, and a central portion 203 separating the cut-outs 201. The central portion 203 is intact with the initial shape of the monoblock 202.

The conductive layer 204 covers the whole surface of the monoblock 202, including the surface inside the symmetrical cut-outs 210. The conductive layer 204 can be formed of a highly conductive material, for example metal. The surface covered by the conductive layer 204 provides an additional electrical ground plane.

The magnetic fields that appear in the monoblock 202 can be similar the ones (H1, H2) shown in FIG. 1*a*. At the outer-most sides of the edges of the monoblock 202, the magnetic fields of orthogonal modes of the resonator 200 are weaker and not parallel as they are near the central portion 203 of the edge that is intact with the initial shape. This effect can be seen more clearly on to FIGS. 1*a* and 1*b*, where the magnetic field lines 111 and 111' are illustrated on a more general level in a dual-mode resonator. Areas where the magnetic fields are mostly parallel are near the central parts of the edges of the monoblock, and this includes the central portion 203 of the edge where the split chamfer 201 is disposed.

Thus, forming a split chamfer 201 with cut-outs 210 on the outer-most sides into the monoblock has less effect on perturbation of the magnetic fields as compared to the central portion. This leads to proportionally smaller errors produced during manufacture, because the size of the split chamfer 201 can be bigger, and provides more control of the perturbation that affects coupling between the orthogonal modes.

In the embodiment shown on FIG. 2*a*, the symmetrical cut-outs 210 have a step-like shape. This can be preferred in certain manufacturing processes. However, embodiments of the disclosure are not limited to a step-like shape of the symmetrical cut-outs 210 of the split chamfer 201.

Figure 2B:
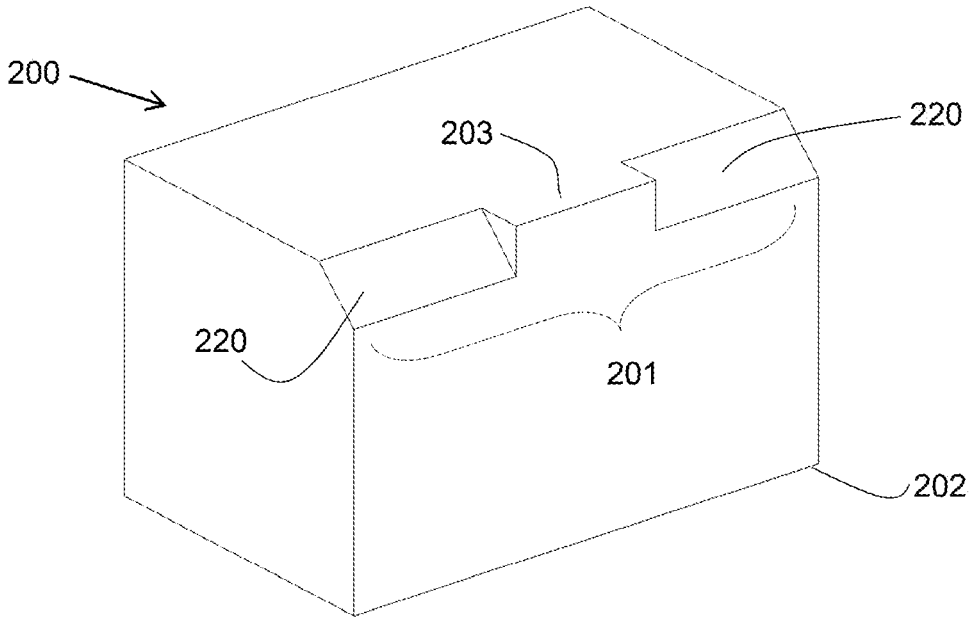

FIG. 2*b* shows that the symmetrical cut-outs 220 may have a different shape, such as an angular cut-out. The choice of the shape may be based on design requirements, manufacturing method and design preferences. Despite the following example embodiments being illustrated with a step-like chamfer, it is clear to a skilled person that the step-like shape can be interchangeable with the angular shape in the embodiments below. The size of the central portion 203 may also vary depending on the amount of perturbation required by the split chamfer, and other design considerations.

Figure 3A:
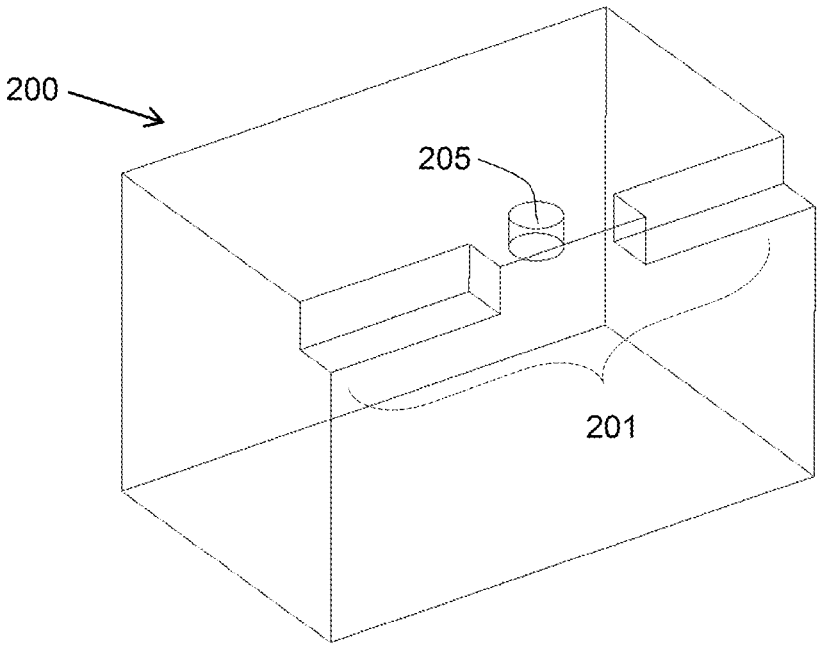
Figure 3B:
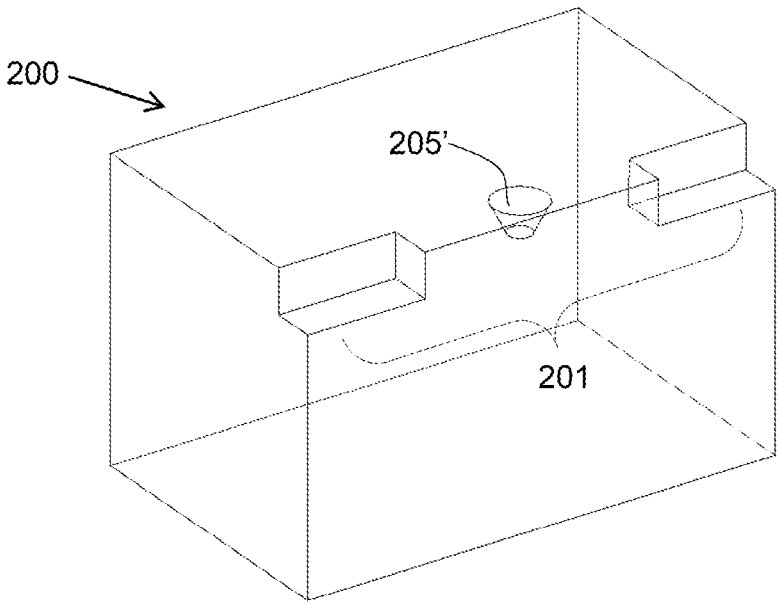

FIGS. 3*a* and 3*b* illustrate an embodiment that expands on the above embodiments by disposing a protrusion 205 at the central portion 203 point between the two cut-outs 210 of the split chamfer 201. The protrusion can have the shape of a cylindrical hole 205, a conical frustum 205', a recessed trench or other shapes not shown in FIGS. 3*a*-3*b*. A cylindrical protrusion 205 can be easier to manufacture, while a protrusion with conical frustum shape 205' can provide better access for partial removal of conductive coating from its surface area. The protrusion 205, 205' is formed in the bulk of the resonator material. The surface area inside the protrusion 205, 205' is covered with the same conductive layer used elsewhere on the resonator 200, or with a different conductive coating.

Including the protrusion 205, 205' augments the coupling by a small amount owing to the inclusion of the conductive ground element in the region of high magnetic fields for the two orthogonal modes. The split chamfer 201 can be reduced in size to compensate for this augmented coupling.

Figure 4:
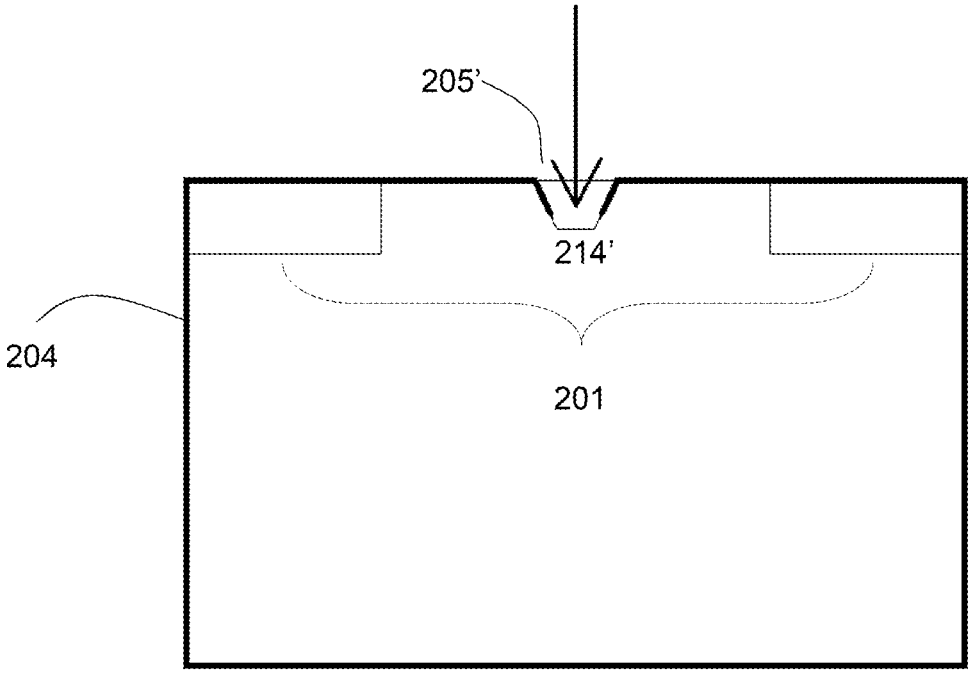

As shown on FIG. 4, the conductive layer 204 can be selectively removed from the inner surface area of the protrusion 205'. The amount of removed material may vary from a small portion on the bottom to maximum removal to the top of the protrusion 205' close to the external resonator surface. The arrow indicates the location of removed conductive coating to affect tuning of the coupling. This creates a gap 214' in the conductive layer 204, and has the effect of gradually moving the conductive ground plane element away from the magnetic fields, thereby reducing the coupling provided by the protrusion. As a result, the coupling can be reduced after manufacture, from the value provided nominally by the split chamfer 201 and the protrusion 205, to a desired value, which has a lower limit for coupling provided nominally by the split chamfer 201 only.

Figure 5A:
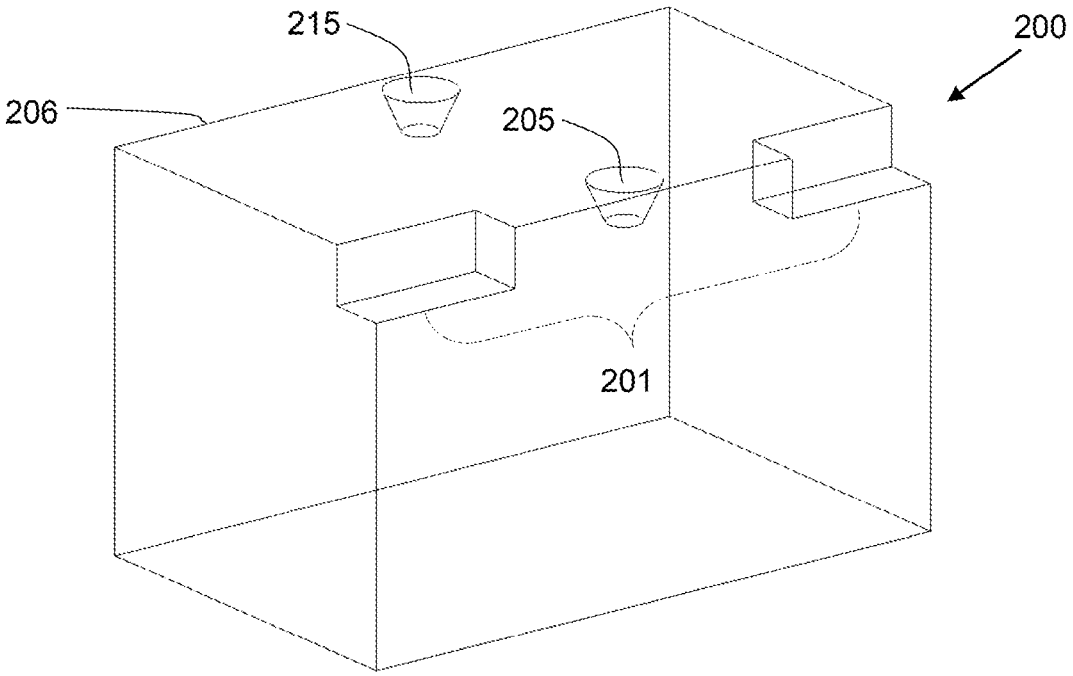
Figure 5B:
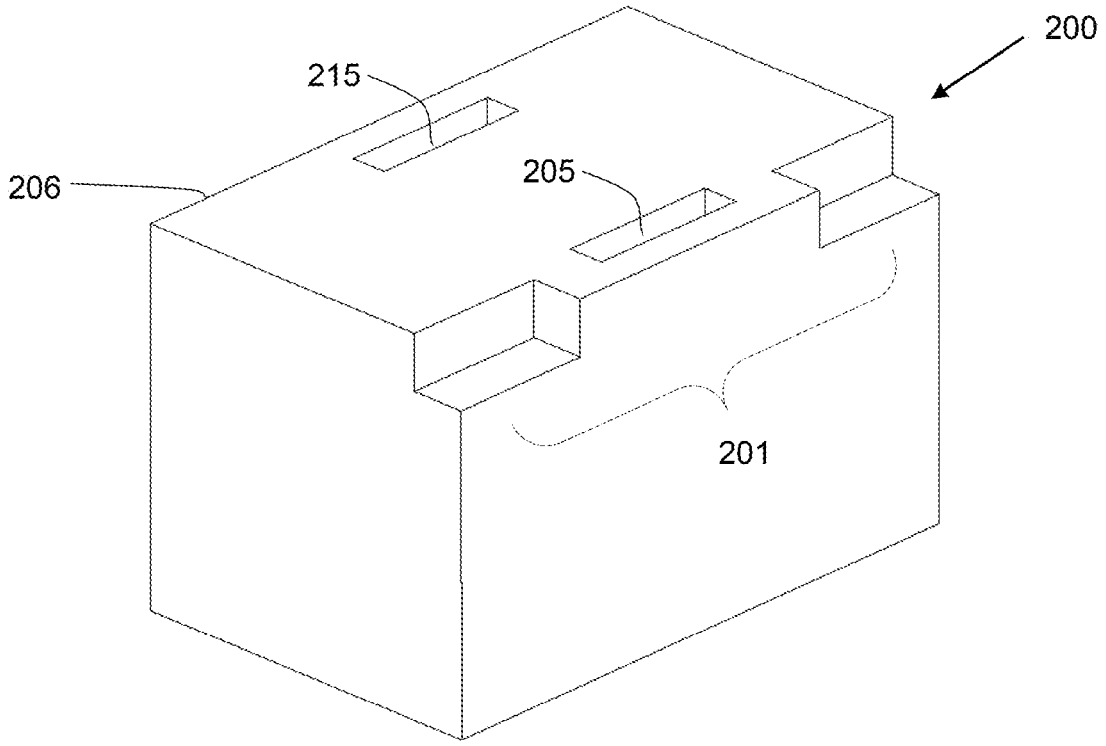

FIGS. 5*a* and 5*b* show an embodiment wherein the dual-mode radio frequency resonator 200 has an additional protrusion 215 on the same surface (area) as the first protrusion 205 but near the opposite edge 206. The additional protrusion 215 may have a cylindrical, conical or any other suitable shape. The additional protrusion 215 disposed as shown on FIG. 5*a* has a similar but opposite effect compared to the first protrusion 205 on the coupling the two orthogonal modes together at a region where their magnetic fields are strongest and most parallel. The magnetic fields near the opposite edge 206 are of opposite polarity to those on the front side with the chamfer 201. In the example embodiment shown in FIGS. 5*a* and 5*b*, two identical protrusions 205, 215 are disposed symmetrically on opposite edges, and so the two couplings will be equal and opposite and thus cancel each other out. The nominal coupling is then provided by the split chamfer 201.

FIG. 5*b* shows an embodiment where protrusions 205, 215 have the shape of a recessed trench. Conductive coating can be removed along the bottom surface of the trenches similar to previous embodiments. The recessed trench shape may be useful in certain manufacturing processes or alignment techniques.

In the structure shown in FIGS. 5*a* and 5*b*, removing the conductive coating from the first protrusion 205 results in the same effect as in embodiments of FIGS. 3*a*-3*b*. The coupling will reduce as the conductive coating is removed from the bottom of the protrusion 205. Removing the conductive coating from the additional protrusion 215 results in a similar local effect, where the coupling associated with this protrusion is reduced. However, as this coupling is of an opposite polarity or sign to the first coupling, reducing this 'negative' coupling results in an overall increase in the total coupling between the orthogonal modes of the resonator 200. Accurate adjustments of the coupling can be made by selective removal of the conductive layer from the surfaces inside the protrusions 205, 215.

In an embodiment, dimensions for the protrusion 205, 215 are 1-2 millimetres in diameter and 1-2 millimetres in depth, and in case of conical frustum or recessed notch shape, with an angle suitable for processing by laser or grinding tool or otherwise. Embodiments of the disclosure are not limited to these dimensions, however, and may be significantly smaller or greater as required, where manufacturing processes allow. Greater dimensions can provide a larger tuning range.

According to an embodiment, the largest diameter of the protrusion 205, 215 will be as small as possible while still allowing the necessary bandwidth adjustment. If the resultant gap 214' formed in the conductive layer 204 after tuning is small enough to have a cut-off frequency significantly higher than the resonator frequency of the dual-mode resonator 200, when all conductive coating needs to be removed, spurious transmission or radiation through the hole will be minimised. Thereby, the protrusions 205, 215 can be designed to contribute minimal additional losses by their inclusion.

Figure 6A:
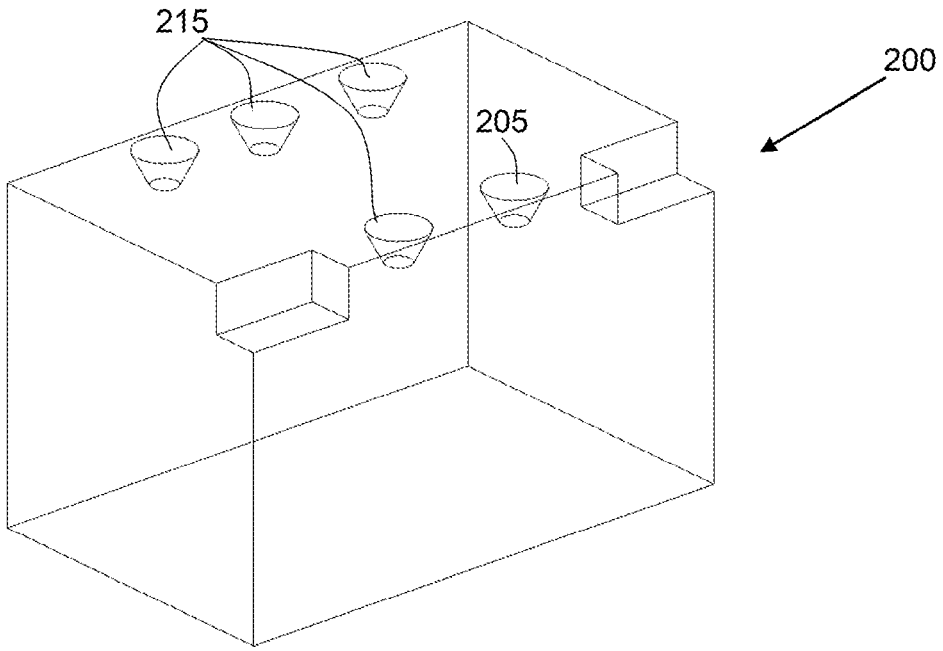
Figure 6B:
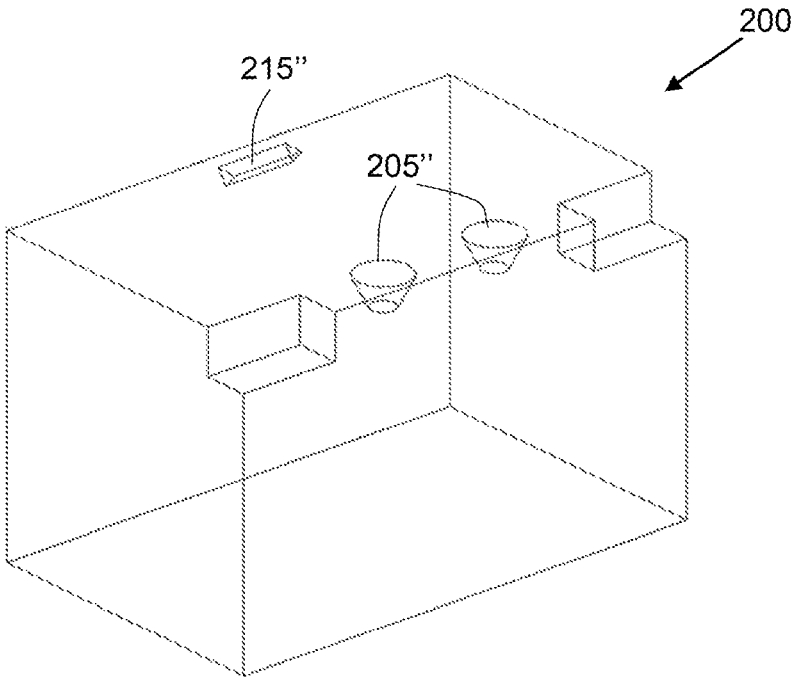

FIGS. 6*a* and 6*b* show embodiments wherein the top surface area of the dual-mode radio frequency resonator 200 has more than one additional protrusion 215. In these embodiments, multiple protrusions 205, 215 are used instead of one pair. This allows for a greater tuning range to be achieved, and can be suitable for cases where higher coupling bandwidths are required. The protrusions 205, 215 may be placed symmetrically or asymmetrically in relation to each other.

The multiple protrusions 205, 215 can affect the coupling in a necessary change, by tuning similarly to the previous embodiments, i.e. selectively removing metallisation starting from the bottom of the protrusions 205, 215.

Any number of additional protrusions 215 can be used in the available space. In an embodiment, an equal number of protrusions is used on each side, so that an equal number of "negative" and "positive" tuning features is used for balanced tuning.

FIG. 6*b* shows an embodiment wherein protrusions of different shapes are combined, as may be appropriate in certain designs. More specifically, FIG. 6*b* shows an example of two protrusions 205" having a conical shape and a "positive" effect on coupling, used in conjunction with a single triangular protrusion 215" having a "negative" effect on coupling.

Figure 7:
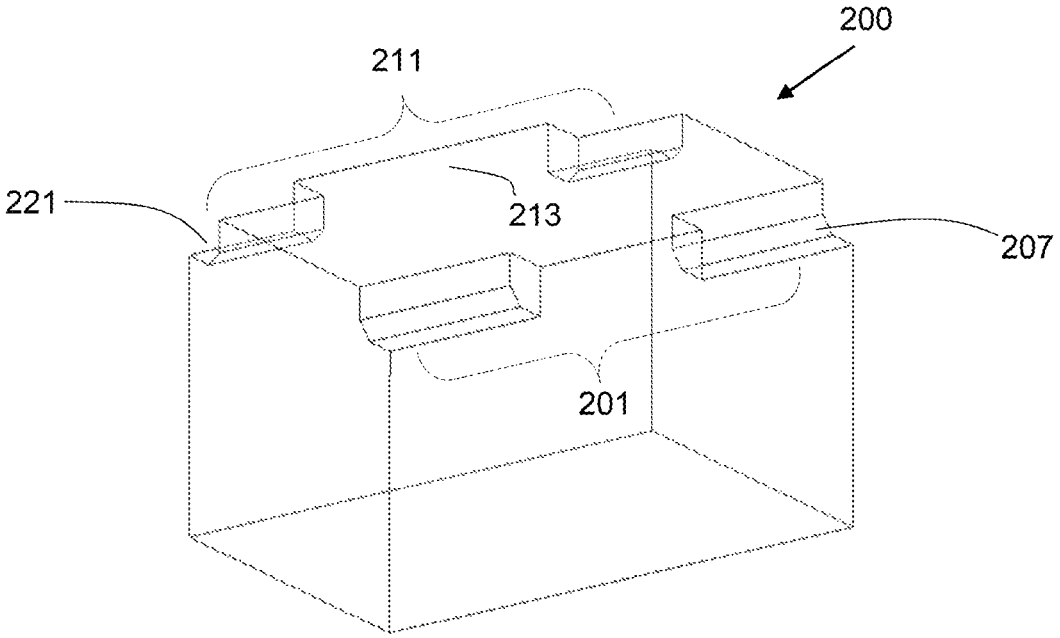
FIG. 7 shows a perspective view of a multimode radio frequency resonator with an additional split chamfer according to an embodiment of the disclosure.

FIG. 7 illustrates an embodiment wherein the dual-mode radio frequency resonator 200 comprises a second split chamfer 211 at an edge opposite to the edge which houses the first split chamfer 201. Like the first split chamfer 201, the second split chamfer 211 includes two symmetrical cut-outs 221 at the outer-most sides of the edge of the monoblock, and a central portion 213 that is intact with respect to the initial shape of the monoblock and separates the symmetrical cut-outs 221.

The second split chamfer 211 provides a negative coupling to counter-act the positive coupling of the first chamfer 201, similar to previous embodiments. The two pairs of symmetrical cut-outs can be of different sizes so as to increase or control the nominal coupling.

In the embodiment shown on FIG. 7, an angled surface 207 is included along the inner-most bottom edge of the cut-outs 221 that have a step-like shape. The cut-outs are covered by the same conductive layer as the rest of the monoblock, and the conductive layer can be selectively removed from the angled surfaces 207 in order to adjust the associated coupling. As in previous embodiments, coupling can be strengthened or weakened by controlling the selective removal of the conductive layer.

Areas of removed conductive layer may radiate more than the protrusions according to previous embodiments; however, a significantly greater range of bandwidth tuning can be achieved.

Figure 8:
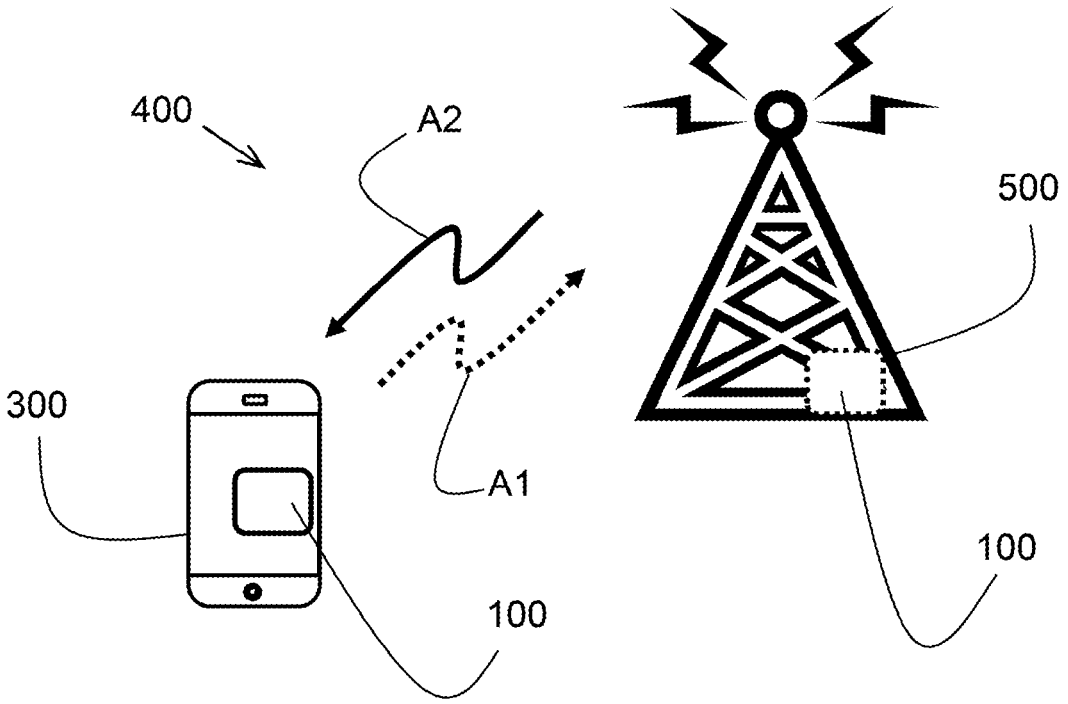
FIG. 8 shows schematically a communication device in a wireless communication system.

FIG. 8 shows schematically a communication device 300 in a wireless communication system 400. The communication device 300 comprises a multimode radio frequency resonator 100 according to any of the embodiments of the disclosure. The wireless communication system 400 also comprises a base station 500 which may also comprise a multimode radio frequency resonator 100 according to any one of the embodiments described above. The dotted arrow A1 represents transmissions from the transmitter device 300 to the base station 500, which are usually called up-link transmissions. The full arrow A2 represents transmissions from the base station 500 to the transmitter device 300, which are usually called down-link transmissions.

The present transmitter device 300 may be any of a User Equipment (UE) in Long Term Evolution (LTE), mobile station (MS), wireless terminal or mobile terminal which is enabled to communicate wirelessly in a wireless communication system, sometimes also referred to as a cellular radio system. The UE may further be referred to as mobile telephones, cellular telephones, computer tablets or laptops with wireless capability. The UEs in the present context may be, for example, portable, pocket-storable, hand-held, computer-comprised, or vehicle-mounted mobile devices, enabled to communicate voice or data, via the radio access network, with another entity, such as another receiver or a server. The UE can be a Station (STA), which is any device that contains an IEEE 802.11-conformant Media Access Control (MAC) and Physical Layer (PHY) interface to the Wireless Medium (WM).

The transmitter device 300 may also be a base station a (radio) network node or an access node or an access point or a base station, e.g., a Radio Base Station (RBS), which in some networks may be referred to as transmitter, "eNB", "eNodeB", "NodeB" or "B node", depending on the technology and terminology used. The radio network nodes may be of different classes such as, e.g., macro eNodeB, home eNodeB or pico base station, based on transmission power and thereby also cell size. The radio network node can be a Station (STA), which is any device that contains an IEEE 802.11-conformant Media Access Control (MAC) and Physical Layer (PHY) interface to the Wireless Medium (WM).

Embodiments of the design are compatible at least with three-axis machining and high-volume, moulded manufacturing methods such as, but not limited to, single axis isostatic-pressing, die-pressing, vacuum forming, superplastic forming, injection-moulding, 3D printing, etc. The conductive material removal from any of the elements described in the embodiments above may be performed by laser ablation, mechanical grinding or any other suitable technique.

What is claimed is:

1. A multimode radio frequency resonator comprising:

a monoblock of dielectric material having an initial shape that allows for multimode resonance, the initial shape comprising surface areas and edges between the surface areas;

a conductive layer covering the surface areas of the monoblock;

a split chamfer disposed at one of the edges of the monoblock, wherein the split chamfer includes: two symmetrical cut-outs at outer-most sides of the edge of the monoblock, and a central portion that is intact with respect to the initial shape of the monoblock and separates the two symmetrical cut-outs; and at least one protrusion protruding into the monoblock, disposed in the central portion of the split chamfer and covered by the conductive layer.

2. The multimode radio frequency resonator according to claim 1, wherein the monoblock has a parallelepiped shape, and the multimode radio frequency resonator is operable as a dual-mode radio frequency resonator.

3. The multimode radio frequency resonator according to claim 1, wherein the monoblock has a cubic shape, and the multimode radio frequency resonator is operable as a triple-mode radio frequency resonator.

4. The multimode radio frequency resonator according to claim 1, wherein the two symmetrical cut-outs along the outer-most sides of the edge have a step-like shape.

5. The multimode radio frequency resonator according to claim 1, wherein the two symmetrical cut-outs along the outer-most sides of the edge have an angular shape.

6. The multimode radio frequency resonator according to claim 1, wherein the at least one protrusion has a cylindrical or conical frustum shape.

7. The multimode radio frequency resonator according to claim 1, wherein the at least one protrusion has a shape of a recessed trench.

8. The multimode radio frequency resonator according to claim 1, comprising a gap in the conductive layer inside the at least one protrusion.

9. The multimode radio frequency resonator according to claim 1, wherein the dielectric material is a ceramic material.

10. The multimode radio frequency resonator according to claim 1, wherein the multimode radio frequency resonator is used in a filter assembly of a multiple-input and multiple-output system.

11. The multimode radio frequency resonator according to claim 1, comprising at least one additional protrusion disposed in a surface area of the monoblock that houses the protrusion in the central portion of the split chamfer.

12. The multimode radio frequency resonator according to claim 11, wherein at least one additional protrusion is located on a side of the surface opposite to the central portion of the split chamfer.

13. A communication device for a wireless communication system, the communication device comprising a multimode radio frequency resonator, wherein the multimode radio frequency resonator comprises:

a monoblock of dielectric material having an initial shape that allows for multimode resonance, the initial shape comprising surface areas and edges between the surface areas;

a conductive layer covering the surface areas of the monoblock;

a split chamfer disposed at one of the edges of the monoblock, wherein the split chamfer includes: two symmetrical cut-outs at outer-most sides of the edge of the monoblock, and a central portion that is intact with respect to the initial shape of the monoblock and separates the two symmetrical cut-outs; and at least one protrusion protruding into the monoblock, disposed in the central portion of the split chamfer and covered by the conductive layer.

14. The communication device according to claim 13, wherein the monoblock has a parallelepiped shape, and the multimode radio frequency resonator is operable as a dual-mode radio frequency resonator.

15. The communication device according to claim 13, wherein the monoblock has a cubic shape, and the multimode radio frequency resonator is operable as a triple-mode radio frequency resonator.

16. The communication device according to claim 13, wherein the two symmetrical cut-outs along the outer-most sides of the edge have a step-like shape.

17. The communication device according to claim 13, wherein the at least one protrusion has a shape of a cylindrical frustum, a conical frustum or a recessed trench.

18. The communication device according to claim 13, comprising a gap in the conductive layer inside the at least one protrusion.

19. A method for tuning a multimode radio frequency resonator, wherein the multimode radio frequency resonator comprises:

a monoblock of dielectric material, a conductive layer covering surfaces of the monoblock, a split chamfer disposed at one of the edges of the monoblock comprising two symmetrical cut-outs at the outer-most sides of an edge of the monoblock, and a central portion comprising at least one protrusion protruding into the monoblock;

wherein the method comprises:

selectively removing the conductive layer from a surface area inside the at least one protrusion, to form at least one non-conductive area on a monoblock surface.

20. The method according to claim 19, wherein the monoblock has a parallelepiped shape, and the multimode radio frequency resonator is operable as a dual-mode radio frequency resonator.

* * * * *